United States Patent [19]

Bourdon

[11] 4,265,505

[45] May 5, 1981

[54] ELECTRICAL CONNECTOR

[75] Inventor: Normand C. Bourdon, Sidney, N.Y.

[73] Assignee: The Bendix Corporation, Southfield, Mich.

[21] Appl. No.: 28,131

[22] Filed: Apr. 6, 1979

Related U.S. Application Data

[63] Continuation of Ser. No. 847,451, Feb. 2, 1978, abandoned.

[51] Int. Cl.[3] ..... H01R 11/20; H01R 13/514

[52] U.S. Cl. ..... 339/99 R; 339/17 F; 339/176 MF

[58] Field of Search ..... 339/96–98, 339/99, 17 F, 176 MF

[56] References Cited

U.S. PATENT DOCUMENTS

| | | | |
|---|---|---|---|
| 837,599 | 12/1906 | Williams | 339/97 R |
| 1,117,650 | 11/1914 | Erlanger | 339/99 L |
| 1,157,075 | 10/1915 | Blackburn | 339/97 L |
| 1,738,287 | 12/1929 | Dirksen | 339/97 T X |
| 2,598,656 | 5/1952 | Bastian et al. | 163/1 |
| 3,725,844 | 4/1973 | McKeown | 339/49 R |
| 4,025,141 | 5/1977 | Thelissen | 339/99 R |

*Primary Examiner*—John McQuade
*Assistant Examiner*—John S. Brown
*Attorney, Agent, or Firm*—Kenneth A. Seaman; Charles D. Lacina; Raymond J. Eifler

[57] ABSTRACT

An electrical connector assembly (10), having one or more electrical contacts (110) mounted therein, each contact (110) including a forward mating end (112) and a rear portion (114) adapted to mate with an insulated electrical conductor (210) without requiring the preparation of the insulated electrical conductor (210) by removal of the external insulation (212). The electrical contact in the assembly includes a plurality of fine, axially aligned wires (114) at the rear portion of the contact, with each wire having an acutely angled end portion (118). The acutely angled end portions of the fine wires project through the insulation (212) of the insulated electrical conductor (210) into the central conductor (214) to provide an electrical connection between the central (metallic) conductor (214) which is located proximate to, and transverse of, the axially aligned wires. Preferably, the contact is mounted to a first housing (100) and the insulated electrical conductor (210) is mounted to a second housing (300) and means (150, 160, 350, 360) are provided to guide and secure said first and second housings together in proper alignment. Such housings may provide protection for the circuit connection between the contact wires (114) and the insulated conductor (210) and provide strain relief for the insulated conductor (210).

5 Claims, 9 Drawing Figures

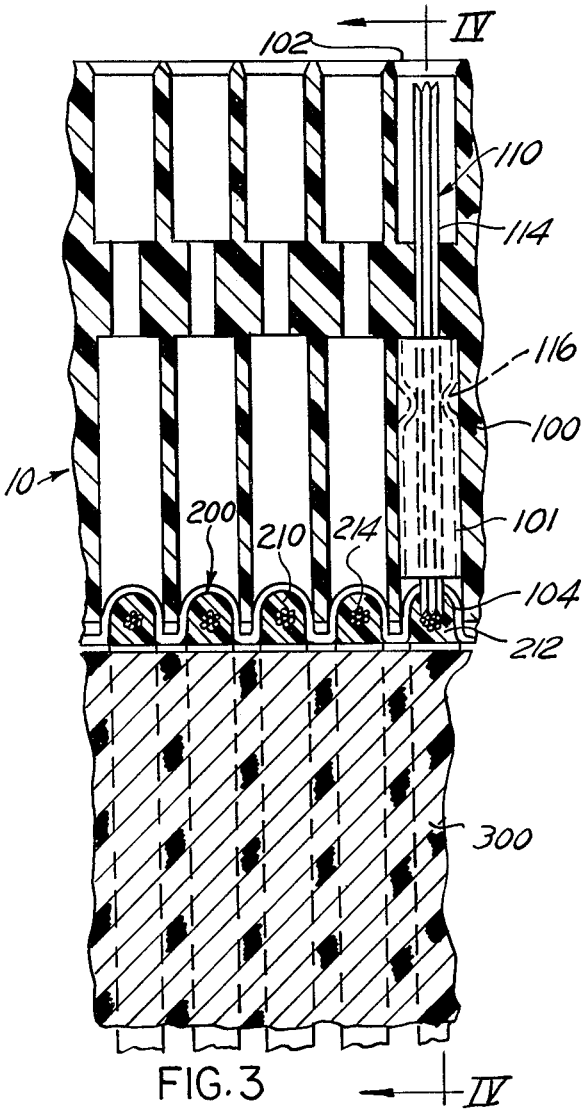
FIG. 3
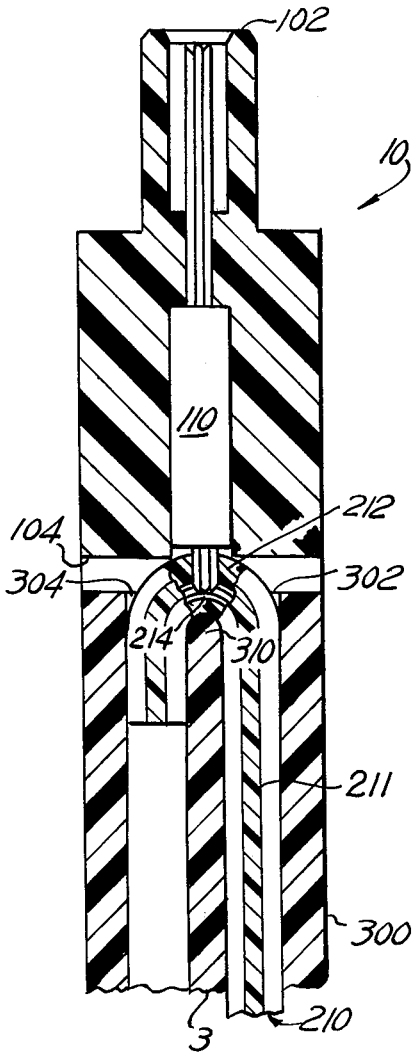
FIG. 4
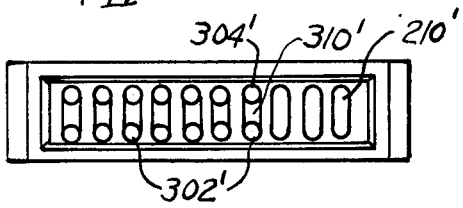
FIG. 6
FIG. 5
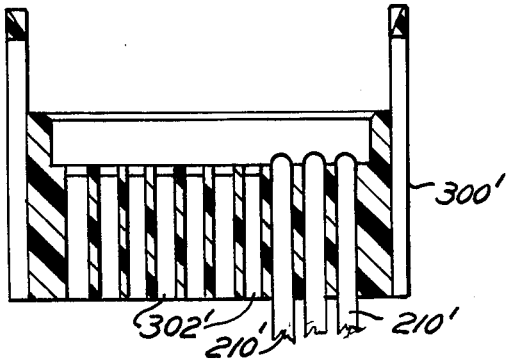

ELECTRICAL CONNECTOR

This application is a continuation of Patent Application Ser. No. 847,451, filed on Feb. 2, 1978, now abandoned.

CROSS REFERENCE TO RELATED PATENT

The present invention is related to and an improvement to the invention described in U.S. Pat. No. 3,725,844 issued Apr. 3, 1973, to McKeown, et al for "Hermaphroditic Electrical Contact", assigned to the assignee of the present invention. That patent is hereafter referred to as the "Brush Contact Patent" and the specification and drawings thereof are hereby specifically incorporated herein by reference.

TECHNICAL FIELD

This invention relates to electrical connectors of the type including a mating electrical contact in electrical circuit relationship with an insulated electrical conductor. More specifically, this invention relates to electrical contacts of the type wherein a plurality of fine wires are held together and axially aligned in a bundle within a sleeve and extending rearwardly therein. The axially aligned wires are urged through a portion of an insulated conductor at a proximate and transverse portion thereof with the fine wire piercing through the insulation of the conductor into the central conductor in an electrical circuit relationship therewith. The electrical contact includes a forward or mating element chosen from one of the many well known types, such as a pin, a socket or those shown in the Brush Contact Patent.

BACKGROUND ART

Electrical contacts of the type including a plurality of axially aligned fine wires held in a sleeve are old and known in the prior art, as shown in the Brush Contact Patent. Such a contact typically includes in the forward portion thereof a plurality of wires axially aligned, each with an acutely angled forward end portion and held toward the rear of the wires within an electrically conducting holder by a crimp. An insulated electrical wire is coupled to the fine wires by removing the end portion of the insulation to expose a central conductor at the end thereof, inserting the exposed conductor into a rear portion of the conducting holder and crimping the sleeve to maintain the conductor in place and in electric circuit relationship with the sleeve.

Preparing the insulated conductor to make a prior art electrical contact is time consuming and adds manufacturing expense and steps.

Such a prior art electrical contact for a connector as disclosed in the Brush Contact Patent also requires an electrically conducting holder or sleeve to make an electrical path between the conductor at the rear and the forward fine wires of the contact. In some applications, a holder made from a non-conducting material or a low conductance material would be more advantageous, as a lower manufacturing cost might result by substituting a material such as plastic.

The process of individually inserting a conductor into each contact and separately crimping the contacts in place is also undesirable in that it requires handling of each conductor separately. Since there are generally a number of electrical contacts in an electrical connector assembly, the handling and installing of each conductor separately can be expensive.

The foregoing and other limitations of the prior art presents problems and costs in the manufacturing of electrical connector assemblies and contacts.

DISCLOSURE OF THE INVENTION

The present invention overcomes the limitations of the prior art by providing an electrical connector assembly which includes an electrical contact having a first mating end and a second end in electrical circuit relationship with said first end and for attachment to an insulated electrical conductor. The second end includes a plurality of axially aligned electrically conducting wires, each with an acutely angled end surface at a far or distal end thereof. The acutely angled end surfaces are adapted to impale the insulated electrical conductor, piercing the insulation to make electrical connection with the electrical conductor.

The electrical connector assembly of the present invention is especially adapted to have a plurality of contacts arranged in spaced relationship, mounted in a first housing. A plurality of insulated wires, arranged in a similar spaced relationship and adapted to be mated simultaneously with each of the respective electrical contacts, is mounted to a second housing. Although a plurality of individual wires could be mounted to the housing in the spaced relationship, the present invention is especially adapted for use with conductors arranged in a spaced ribbon.

The first electrical connector assembly, described above, has a plurality of passages, with a contact mounted in each passage. The contact (110) includes a plurality of straight fine wires (114), each with an acutely angled rear end portion (118) and axially aligned to form a bundle. The acutely angled rear end portion (118) of each of the wires is adapted to engage a transverse portion of an insulated electrical conductor (210) by piercing through the insulation (212) and engaging the central electrical conductor (214). The transverse portion of the insulated conductor is held in place by the second housing.

The present invention allows the assembly of an insulated electrical wire to an electrical contact without requiring that the insulated first be removed from the conductor of that the wire by prepared to have an exposed portion.

The present invention also allows a plurality of electrically conducting wires to be easily and quickly assembled in electrical circuit relationship with a plurality of respective contacts, with said wires and contacts arranged in a spaced relationship.

It is a further object to provide, in one embodiment of the present invention, and electrical connector with a plurality of electrical contacts, each having a holder or sleeve for holding a plurality of axially aligned wires in which the sleeve or holder need not be electrically conducting. In such embodiment, the axially aligned wires extend completely from the forward mating and through the sleeve and into the electrical conductor at the rear and provide a current path themselves, thereby elminating the necessity of providing an electrically conducting sleeve to provide a current path.

Accordingly, it is an object of the present invention to provide an novel electrical connector assembly and a novel method of manufacturing the assembly which is economical and reliable.

Further, it is an object of the present invention to provide a novel method of connecting an electrical contact to an insulated electrical conductor.

The foregoing and other objects and advantages of the present invention will be apparent to one skilled in the art in view of the following description and the accompanying drawings.

BRIEF DESCRIPTION OF THE DRAWINGS

FIG. 3 is a partial cross-sectional view of an assembled electrical connector of an alternate embodiment of the present invention.

FIG. 4 is a cross-sectional view of the connector shown in FIG. 3, the view looking in the direction of the line IV—IV in FIG. 3.

FIG. 5 is a cross-sectional view of another embodiment of a portion of the present invention, showing a housing captivating individual insulated conductors and providing strain-relief for the conductors.

FIG. 6 is a top view of the housing shown in FIG. 5.

DETAILED DESCRIPTION OF THE DRAWINGS

Figure 1:
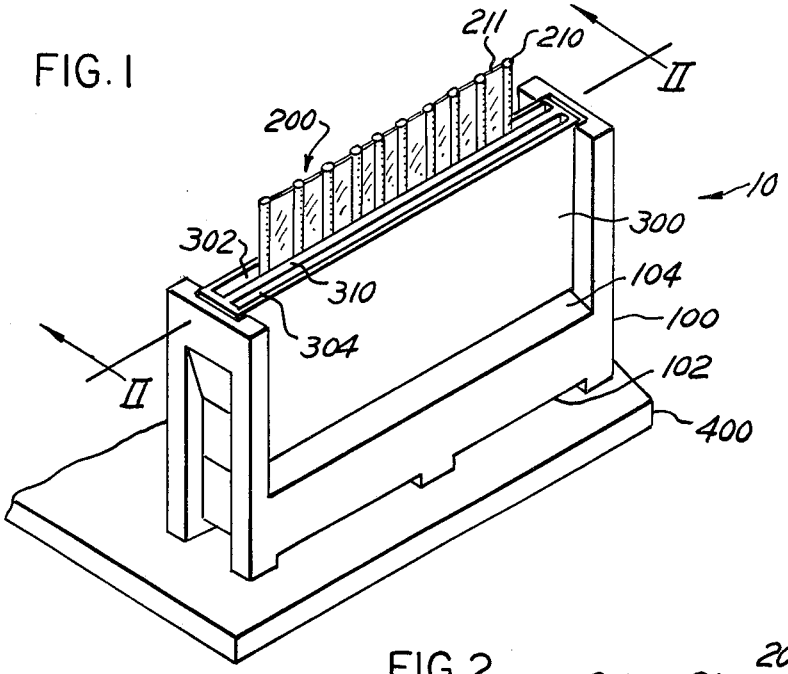
FIG. 1 is a perspective view of one embodiment of the present invention.

FIG. 1 illustrates an electrical connector 10 of the present invention. The connector 10 includes a first housing 100 and a multiple-conductor ribbon 200 mounted to a second housing 300. The first and the second housings are assembled together and are mounted to a printed circuit board 400.

The multiple conductor ribbon 200 is a commercially available type such as is sold by the 3M Company under the trademark Scotchflex brand. The ribbon 200 includes a plurality of individually insulated conductors 210 generally parallel to one another and formed into a single piece with connecting material 211 between the conductors. The second housing 300 includes two parallel passageways 302, 304 surrounding a central tongue portion 310 of the housing 300. The ribbon 200 extends through one passageway 302 toward the first housing 100 and is wrapped around the lower edge (not shown) of the tongue portion 310 proximate to the first housing 100. A portion of the ribbon 200 is inserted into the lower portion of the second passageway 304, not shown in FIG. 1.

The first housing 100 includes a forward mating surface 102 with contacts for mating with the circuit board 400 and a rear surface 104 for connection with the electrical conductors 210 in the ribbon.

Figure 2:
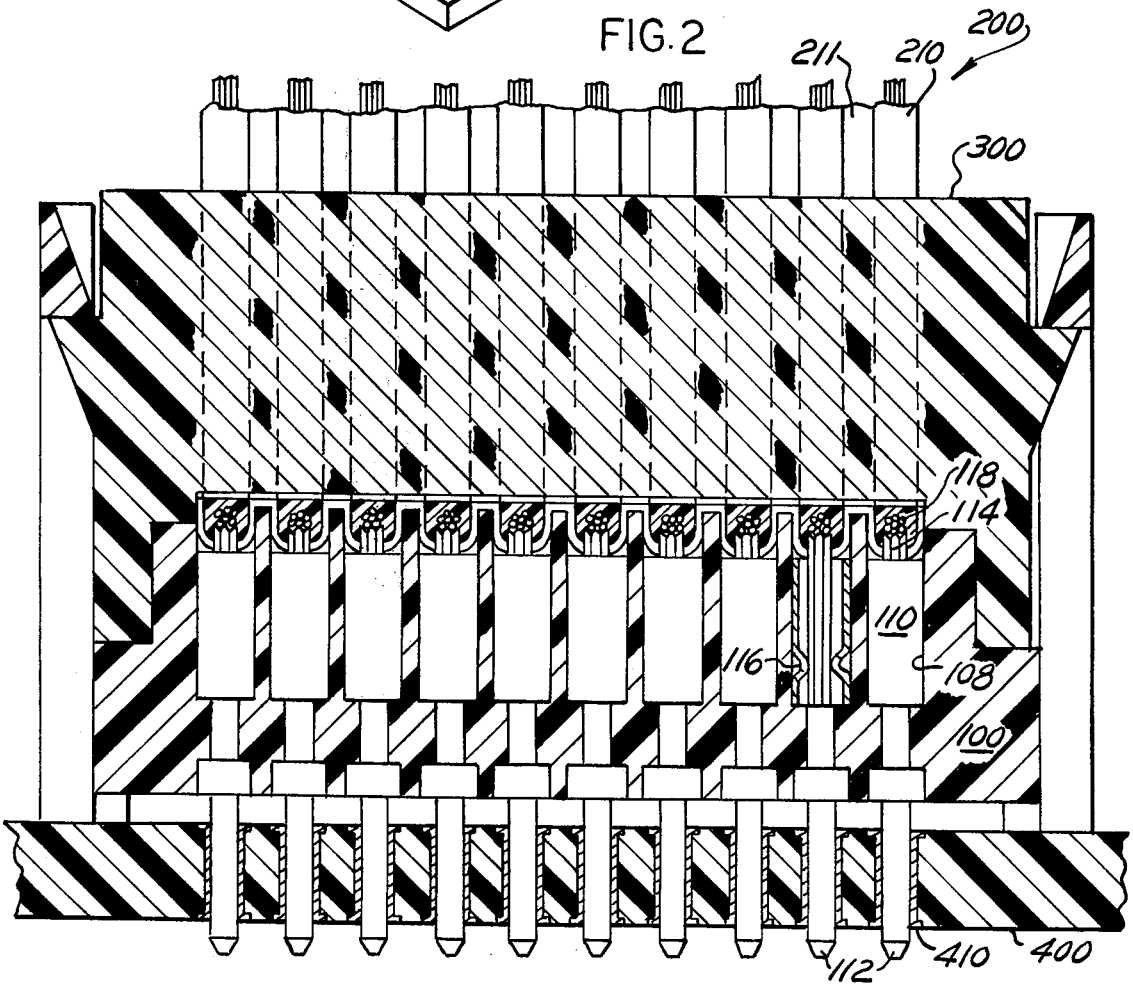
FIG. 2 is a cross-sectional view of the electrical connector of FIG. 1 looking in the direction of the line II—II.

FIG. 2 shows a cross section view of the assembly of FIG. 1, locking along the line II—II and thereby showing the detail of the interior structure of the housings 100, 300 and the connection of electrical contacts 110. Mounted to the first housing 100 is a plurality of electrical contacts 110, each in a separate passage 108. The passages 108 are generally axially aligned and spacially separated from an adjacent passage by a uniform distance. Each electrical contact 110 includes a forward mating portion 112 and a rear portion including a plurality of axially aligned fine wires 114 which are held in place in a known manner, such as a crimp 116. The axially aligned wires each have a rear end portion having an acutely angled end surface 118. The acute angle on the end surface 118 is preferably 30°, although greater or lesser angles could be used advantageously to practice the present invention.

The fine wires 114 of the present invention make up a bundle which is generally disclosed in the Brush Contact Patent which has been incorporated by reference in the present application. In one embodiment of the invention, seven strands of Berylium Copper wire, each having a diameter of 0.008 inch, are used, although other materials, size of wires or stand count could be substituted without departing from the spirit of the present invention.

FIG. 3 shows a partial cross-sectional view of an alternate embodiment of the electrical connector 10 of the present invention. The electrical connector contact 110 includes a sleeve 101 and a plurality of axially aligned wires 114 having opposite ends, the sleeve being mounted medially around the axially aligned wires and the wires extending through the contact from the ends proximate the forward mating surface 102 to the ends proximate the rear portion 104 at which the insulated conductors 210 are mounted. The first housing 100, the second housing 300 and the ribbon 200 of insulated conductors may be unchanged from those described in FIG. 1. The sleeve 101 of electrical contact 110, which must retain the fine wires 114 in axial and radial position, includes an inwardly crimped portion 116 to maintain the wires in the proper position. Each of the wire distal end portions include acutely angled end surfaces, one of the plurality of ends being adapted to impale and pierce the insulation of and make electrical connection with the conductor 214. The other of the plurality of wire ends are exposed for mating with another contact.

FIG. 4 shows a partial cross-section side view of the connector 10 shown in FIG. 3, looking along the line IV—IV. The insulated conductor 210 is shown in partial cross section, showing the insulation 212 and the central conductor 214 which, although shown in its preferred embodiment as a plurality of strands, might be a single strand of various cross sectional shapes or configurations as are commercially available.

The conductor 210 is shown extending through the one passageway 302 of housing 300, over the tongue portion 310 and then into the second passageway 304, where the free end of the conductor 210 terminates.

The rear end portions of the axially aligned wires 114 have the acutely angled end surfaces 118 which pierce through the insulation 212 and into contact with the central conductor 214 of the insulated conductor 210. In this way, the forward mating portion of the contact 110 is connected in electric circuit relationship with the central conductor 214 of the insulated conductor 210.

FIGS. 5 and 6 show an alternate embodiment of the second housing 300' adapted to use individually-mounted insulated wires 210' rather than a ribbon including a plurality of wires.

In FIG. 5, a plurality of slots 302' is provided in the housing include 300'. The three slots on the right side of the housing conducting wires 210' inserted therein while the remainder of the slots 302' remain vacant.

FIG. 6 shows the housing 300' of FIG. 5 from the top. The housing 300' includes the plurality of parallel slots 302' and a second plurality of similarly spaced slots 304'. Between one slot 302' and a corresponding slot 304' is a transverse groove 310' for defining a position for the wire 210' when inserted between the slots.

Figure 7:
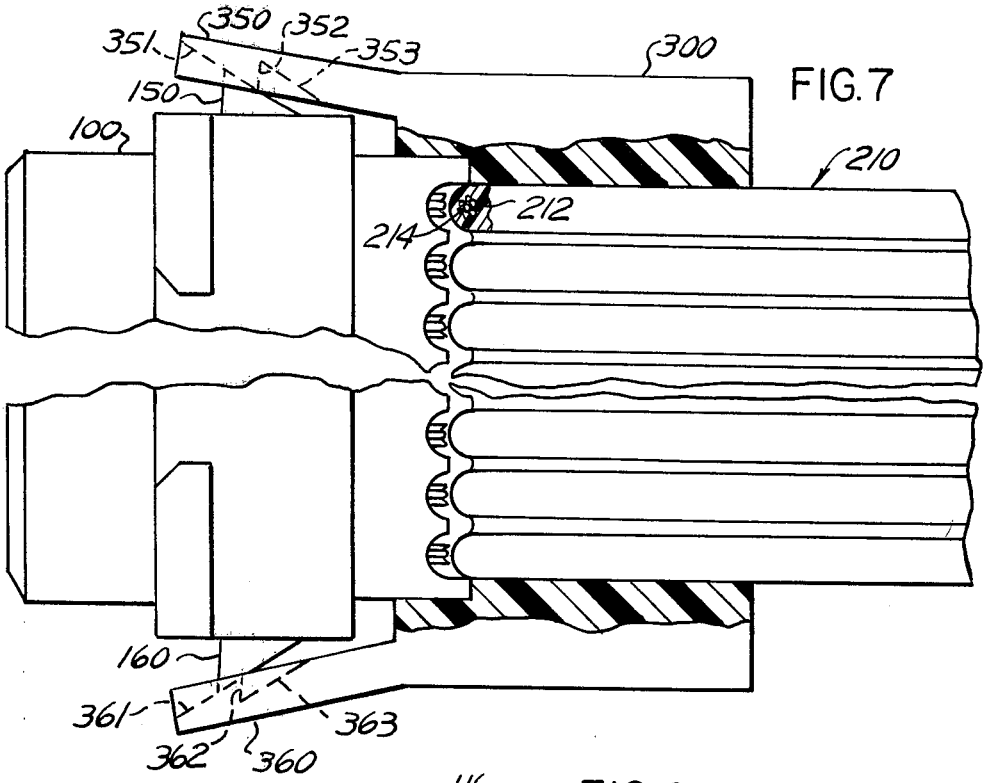
FIG. 7 is a partial cross-sectional view of an electrical connector assembly (partially assembled) including the conductor termination of the present invention.

FIG. 7 shows the first housing 100 and the second housing 300 being assembled. The first housing 100 is provided with a pair of outwardly-extending triangular portions 150, 160. Arms 350, 360 are yieldably mounted to the housing 300 to allow outward deflection along ramps 351, 361 by the triangular portions 150, 160 respectively as the first and second housings are assembled together. When the housings are fully assembled, the triangular portion 150 is captivated between the surfaces 352, 353 on the arm 350 and the triangular portion 160 is captivated between the surfaces 362, 363 on the arm 360.

Figure 8:
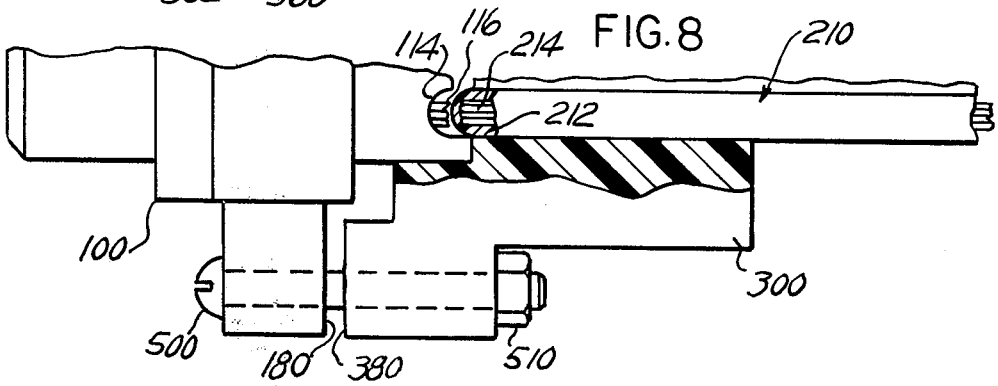
FIG. 8 is a partial cross-sectional view of an alternate partially-assembled embodiment of the present invention.

FIG. 8 shows an alternative embodiment for securing the first housing 100 to the second housing 300. A screw hole is provided in an end portion of each housing, through which a screw 500 is placed. A nut 510 is threaded onto the screw 500 and tightened to bring the rear ends 118 of axially aligned wires 114 into the central conductor 214 of the insulated wire 210. Once the wires are brought in the conductor 214 by the tightening of the screw 500, a forward portion 380 of the housing 300 and a rear portion 180 of the housing 100 will be in contact and resist further tightening of the screw 500.

Figure 9:
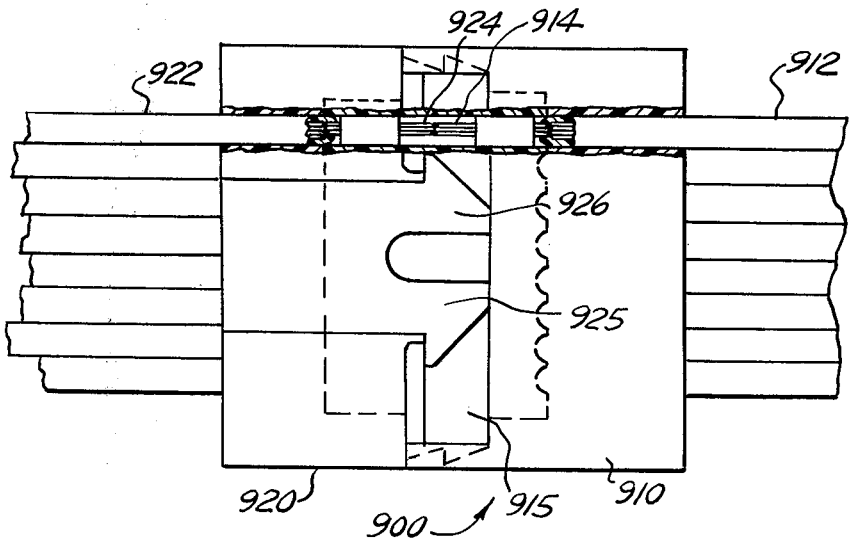
FIG. 9 is a partial cross-sectional view of a mated pair of electrical connectors demonstrating one embodiment of the present invention.

FIG. 9 shows a mated electrical connector assembly 900 in which two connectors 910, 920 of the type shown in FIG. 3 are mated. The connector 910 includes a ribbon 912 of electrical conductors at the rear end thereof and forward mating contact 914 of the type described in the Brush Contact Patent. The connector 920 includes a ribbon 922 and forward mating contact 924 which are mated with the contact 914 which are mated with the ribbon 912. A locking mechanism including yieldable triangular portions 925, 926 mates with recepticle 915 to secure the Connectors 910, 920 together with the contacts 914, 924 mated in electric circuit relationship.

Other modifications to the systems of the invention will become apparent to those skilled in the art to which it pertains without deviation from the spirit of the present invention as defined by the appended claims.

What is claimed is:

1. An electrical connector assembly comprising:

a body of insulative material including a plurality of passages extending therethrough;

a contact disposed for mating in one of said passages, said contact including a sleeve and a plurality of axially aligned contact wires of conductive material, each of said contact wires having a tapered forward end portion and a tapered rearward end portion, said sleeve being disposed medially said end portions of the contact wires and including means for securing medial portions of said wires within said sleeve to prevent the wires from displacing axially with respect to the sleeve, the forward end portions of said contact wires being disposed for mating with another contact and the rearward end portions of said contact wires being exposed for impaling an insulated conductor wire; and means for securing the insulated conductor wire to the tapered rearward end portions of said aligned contact wires, said insulated conductor wire having a portion mounted transverse to the contact wires with the rear tapering end of the contact wires piercing through the insulation and into the conductor wire, the impaling resulting in said another contact making electrical contact with the central wire of the insulated conductor.

2. An electrical connector assembly of the type described in claim 1 wherein the means for securing the axially aligned wires to the sleeve is a crimp of the sleeve extending radially inward for retaining the contact wires.

3. An electrical connector assembly of the type described in claim 1 wherein the means for securing the insulated conductor wire to the exposed rearward end portion of the contact wires comprises a second body of insulative material including a face extending transverse to the contact wires, means for securing the insulated conductor wire in place along the transverse face, and means for coupling said bodies together to urge the contact wires into the transversely extending insulated conductor wire.

4. An electrical connector assembly of the type described in claim 1 wherein the tapering ends of the contact wires are approximately a 30° angle at each end.

5. An electrical connector assembly comprising:

a body of insulative material including a plurality of passages extending therethrough;

a contact member mounted in one of said passages, said contact member including a retention member mounted medially around a plurality of axially aligned contact wires of conductive material, each of said wires having forward and rearward tapering end portions and each being adapted to complete an electrical connection, said retention member including means securing said wires thereto to prevent the wires from displacing axially with respect to the retention member, the forward ends of said contact wires being disposed for mating with another contact and the rearward ends being exposed for impaling penetration of an unprepared insulated conductor wire; and means for securing the unprepared insulated conductor wire to the rear tapering ends of said aligned contact wires, said insulated conductor wire having a portion thereof mounted transverse to the contact wires with the rear tapering end of the contact wires piercing through the outer layer of the insulation and into electrical contact with the conductive material of the insulated conductor wire whereby the contact wires electrically interconnect the insulated conductor wire with said another contact.

* * * * *